US006311468B1

(12) United States Patent
Beckmann et al.

(10) Patent No.: US 6,311,468 B1
(45) Date of Patent: Nov. 6, 2001

(54) DEVICE FOR PRODUCING A TWISTED YARN BY AN INTEGRATED SPINNING AND TWISTING PROCESS AS WELL AS FIBER FEED TUBE

(75) Inventors: Markus Beckmann, Krefeld; Karl-Josef Brockmanns, Willich; Ingo Filz, Viersen; Roland Greis, Tönisvorst; Stefan Kross, Viersen; Guido Spix, Kaarst, all of (DE)

(73) Assignee: Volkmann GmbH & Co. (DE)

( * ) Notice: Subject to any disclaimer, the term of this patent is extended or adjusted under 35 U.S.C. 154(b) by 0 days.

(21) Appl. No.: 09/499,584

(22) Filed: Feb. 7, 2000

(30) Foreign Application Priority Data

Feb. 9, 1999 (DE) ..... 199 05 184

(51) Int. Cl.[7] ..... D01H 4/00
(52) U.S. Cl. ..... 57/409; 57/58.49
(58) Field of Search ..... 57/58.49, 58.54, 57/58.52, 58.7, 58.83, 411, 412, 413

(56) References Cited

U.S. PATENT DOCUMENTS 3,411,283 * 11/1968 Isomura ..... 57/413
3,455,097 * 7/1969 Rajnoha et al. ..... 57/409
5,479,771 * 1/1996 Ballhausen et al. ..... 57/409
5,491,966 * 2/1996 Billner ..... 57/409
5,499,496 * 3/1996 Stenmans ..... 57/406
5,509,263 * 4/1996 Lossa ..... 57/409
5,581,991 * 12/1996 Billner ..... 57/413
5,628,177 * 5/1997 Ballhausen et al. ..... 57/406
5,632,140 * 5/1997 Ballhausen et al. ..... 57/409

* cited by examiner

*Primary Examiner*—Danny Worrell
(74) *Attorney, Agent, or Firm*—Robert W. Becker & Associates; Robert W. Becker

(57) ABSTRACT

A device for producing a twisted yarn by an integrated or combined spinning and twisting process is provided and comprises a two-for-one twisting spindle with at least two spinning rotors, positioned within the yarn balloon produced by the twisting process, for producing the individual yarns to be twisted, into which spinning rotors the disentangled fiber material is supplied respectively by the fiber supply tubes, which are connected to the fiber material disentangling units. The fiber material disentangling units are combined to a single fiber material disentangling apparatus with common drive elements for the two disentangling units. The fiber material disentangling apparatus is arranged at least partially below the two-for-one twisting spindle so that the individual spindles can be arranged relatively closely adjacent to one another, wherein each fiber supply tube follows over a portion of its length a circular arc wherein the angle a of directional change to the radius of curvature (r) of the central line of the tube has a ratio of $\alpha/r=2.5$ to 3.5.

14 Claims, 3 Drawing Sheets

DEVICE FOR PRODUCING A TWISTED YARN BY AN INTEGRATED SPINNING AND TWISTING PROCESS AS WELL AS FIBER FEED TUBE

BACKGROUND OF THE INVENTION

The invention relates to a device for producing a twisted yarn by an integrated spinning and twisting process, comprising a two-for-one twisting spindle with at least two spinning rotors arranged within the yarn balloon formed by the twisting process, for producing the individual threads to be twisted, to which spinning rotors disentangled fiber material is supplied with the respectively correlated fiber-feed tubes which are connected to the fiber material disentangling units.

In such a device, as disclosed in German Patent Document 43 31 801 C1, disentangled fiber material is supplied to two open end spinning rotors mounted within a two-for-one twisting spindle for producing two spun yarns. The two spinning rotors in this context have substantially the function of the otherwise provided supply bobbins of conventional two-for-one twisting spindles, i.e., the individual spun yarns produced by the two spinning rotors are processed in the further course of the method in the same manner and are twisted as if they were pulled off two supply bobbins in the form of individual yarns.

German Patent Document 43 07 296 C1 discloses a conventional two-for-one twisting spindle in which a flowable medium, for example disentangled fiber material carried by an airflow, is supplied at diametrically opposed locations into the space defined by the yarn balloon resulting from the spinning process.

German Patent Document 37 34 544 C2 concerns a feed channel positioned between a fiber material disentangling unit and an open end spinning rotor. The feed channel has a shape that deviates only slightly from a straight line by being slightly angled. A first longitudinal section of this channel tapers in the fiber transport direction so that the air transporting the fibers is accelerated which also accelerates the fibers floating therein so that they are stretched as well as arranged in parallel. Since the fibers have a greater inertia in comparison to air, they cannot reach the same velocity in this first longitudinal section as the air transported therein. For this reason, downstream of the first conically tapering longitudinal section a substantially cylindrical longitudinal section is connected at an obtuse angle in which the air substantially does not change its velocity while the fibers in this longitudinal section undergo an after acceleration. The fibers have the opportunity during this adjustment to the air velocity to stabilize in their position. Overall, the fiber supply channel is designed such that the fibers on their path from the fiber material disentangling unit to the spinning rotors will experience a deflection that is as little as possible.

The invention has the object to configure a device of the aforementioned kind as known from German Patent Document 43 31 801 C1 such that it is as space-conserving as possible so that for a preset machine length as many as possible integrated, respectively, combined spinning and twisting apparatus including the required fiber material disentangling units can be mounted.

SUMMARY OF THE INVENTION

As a solution to this object, a device according to the features of claim 1 is provided.

Of special importance are the features of claims 5 through 8 by themselves or in combination in order to ensure a reliable feeding action of the fiber material into the spinning rotors. The curved shape of the fiber supply tubes allows an especially narrow construction of the fiber material disentangling apparatus comprising respectively two disentangling units.

The invention relates also generally to a curved fiber supply tube for fiber material that is conveyed through a tube by a suction airflow. In order to ensure an undisturbed fiber transport between tightly spaced fiber material processing units, a tube with the features of claim 10 is inventively suggested.

BRIEF DESCRIPTION OF THE DRAWINGS

The invention will be explained in the following with the aid of the drawings, in which.

DESCRIPTION OF PREFERRED EMBODIMENTS

Figure 1:
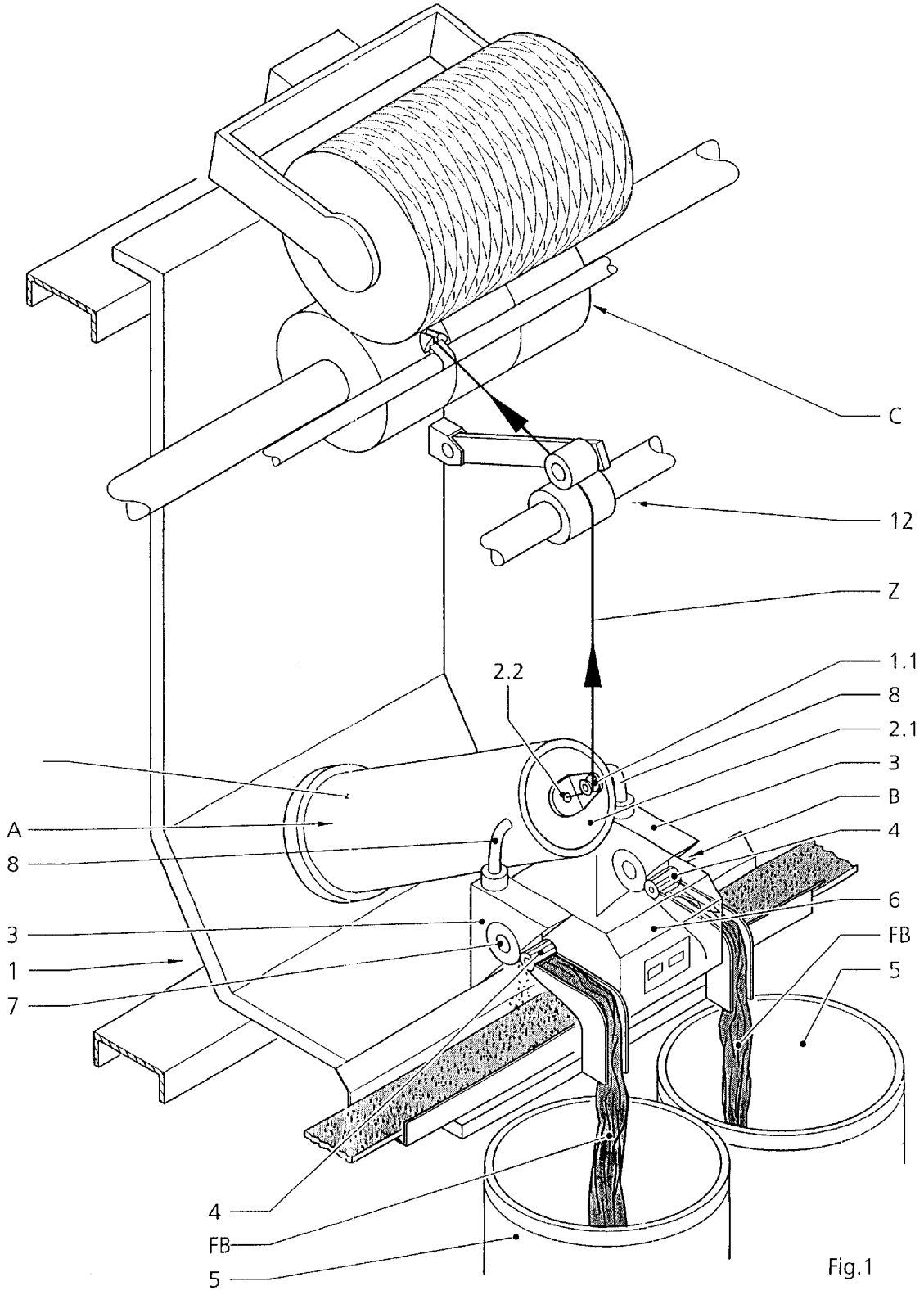
FIG. 1 shows a perspective view of a two-for-one twisting spindle with spinning rotors integrated into the spindles.

FIG. 1 is a detailed view of an individual two-for-one twisting spindle A as part of a combined two-for-one twisting machine. The spindle A is represented by its outer housing 2. The central axis of the twisting spindle, i.e. of the outer housing 2, is slanted relative to a vertical line at an angle of 68 to 76°, preferably 72°, relative to the partially represented machine frame 1. With this slanted arrangement of the two-for-one twisting spindle its operation and the performance of service work after removal of the housing lid 2.1 is facilitated and the total height of the machine is reduced.

The two-for-one twisting spindle A has arranged uptreapinin thereof a fiber material distangling apparatus B comprising two essentially schematically represented fiber material disentangling units 3 to which with the conventional feed rollers 4 fiber silvers FB coming from silver cans 5 are supplied. Downstream of the two intake rollers 4 fiber material disentangling rollers are arranged. One disentangling roller 7 for the left disentangling unit 3 is schematically represented in the drawing.

In the housing 6 of the fiber material disentangling apparatus B two (not represented) drive motors are arranged wherein one motor acts on the intake rollers 4 and the other motor on the two disentangling rollers 7.

Figure 2:
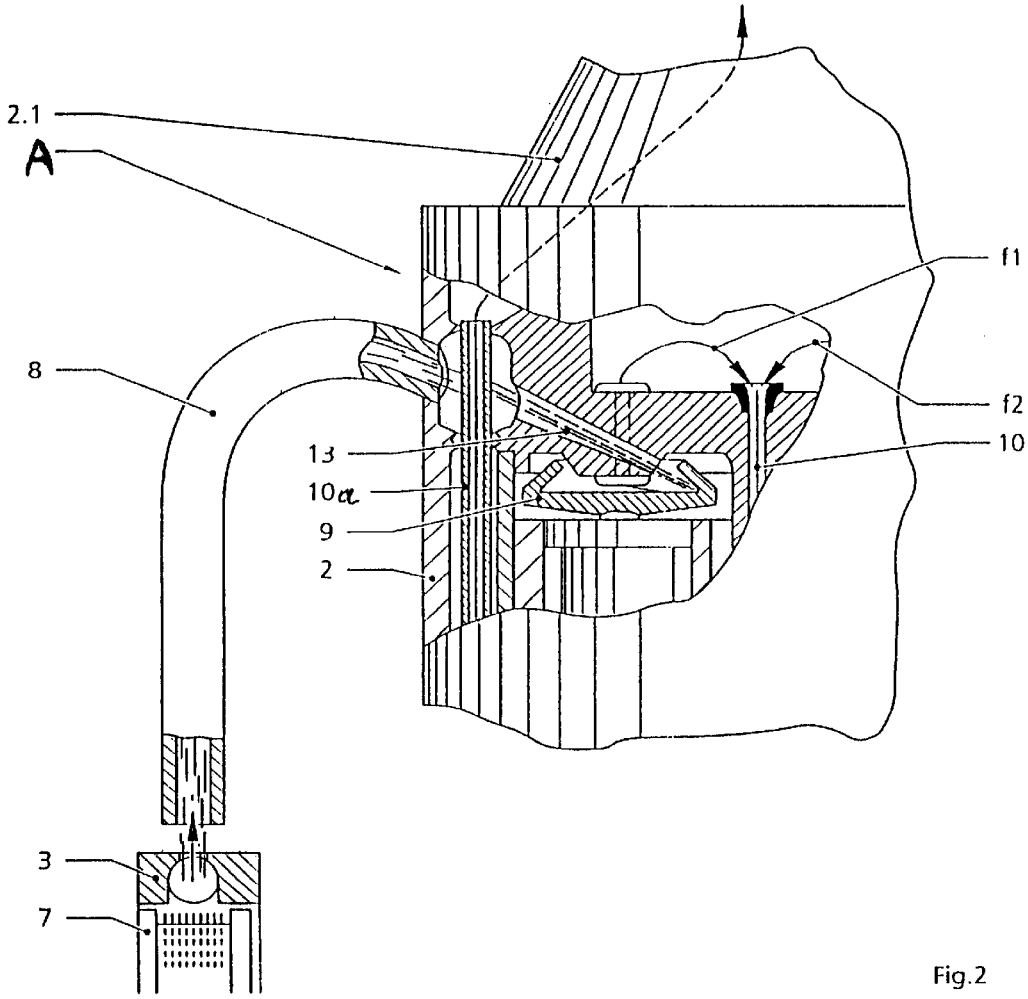
FIG. 2 shows a detail, partially in section, of the two-for-one twisting spindle.
Figure 3:
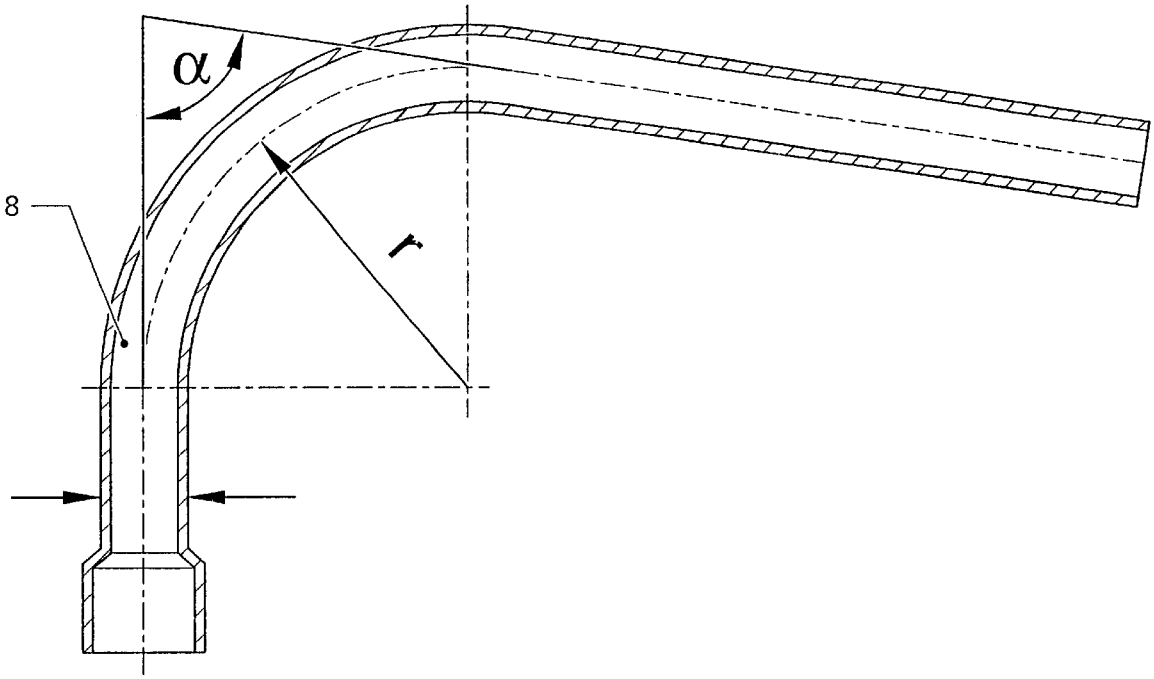
FIG. 3 shows a sectional view of the inventively employed fiber supply tube.

Each one of the disentangling units 3 is connected by a fiber supply tube 8 to the two-for-one twisting spindle A, i.e. to its housing 2, in order to supply in the manner represented in Fig. 2 the disentangled fiber material into the open end spinning rotors 9 arranged within the two-for one twisting spindle. Of the two spinning rotors, which are arranged axis-symmetrically in the two-for-one twisting spindle, only one, i.e the spinning rotor 9 to the left, is represented.

The two-for-one twisting spindle A, which is represented only partially in FIG. 2 and has an integrated spinning rotor 9, is a conventional combined spinning and twisting system, as disclosed in German Patent Document 43 31 801 C1.

In this known combined spinning and twisting process employing a two-for-one twisting spindle, the basic idea lies in that the fiber material supplied through the rotating yarn balloon in the twisting spindle is directly used for producing a twisted yarn of at least two spun yarns. The fiber material is supplied in such a way to the spinning rotors that, on the one hand, it does not disturb the fiber balloon and, on the other hand, there is enough space provided to accommodate in the space defined by the yarn balloon several spinning devices in the form of open end spinning rotors to which the fiber material is supplied in separate streams. The spun yarns removed from the spinning rotors are together guided through the hollow spindle axle and the yarn balloon. The two spinning rotors and their drive mechanisms thus take over the space that in conventional two-for-one twisting methods is occupied by the supply bobbins.

Referring to the representation of FIG. 2, fiber material is guided for each spinning rotor 9 into the interior of the spindle through the envelope that is formed by the yarn balloon or a yarn guide tube 10*a* corresponding to the yarn balloon. The two spinning rotors are driven by electric motors in an opposite direction to the rotational direction of the spindle rotor of the two-for-one twisting spindle. A spun yarn f1, f2 is removed in the upward direction from each of the spinning rotors and is guided into the hollow spindle 10 of the two-for-one twisting spindle. The yarn that is guided downwardly through the hollow spindle 10 is then further conveyed through the conventional yarn guide channel (not represented) radially outwardly and deflected upwardly along the yarn guide tube 10*a* that rotates with the spindle rotor. It is then transported to a centering eye at the center point of the housing lid 2.1 and is subsequently guided via deflecting roller 1.1 to the removal apparatus 12 and from there to a conventional yarn winding apparatus C.

Instead of the yarn guide tube 10*a* the balloon yarn can also be guided along the conventional balloon limiter of a two-for-one twisting spindle.

In this known spinning and twisting process, either the balloon yarn or the yarn guiding tube 10*a* intercepts with its upper portion once for each revolution the fiber stream supplied via the respective fiber supply tube 8 which is supplied directly via a fiber material supply channel 13 connected thereto into the spinning rotor 9.

The supply or feeding of the disentangled fiber material to or into the open end spinning rotors 9 in accordance with German Patent Document 43 31 801 C1 is realized by vacuum which is produced in the area of the spinning rotors via a vacuum tube that extends within the area of the hollow spindle and is connected with its outer end to a vacuum source. Air channels are connected to the interior of this vacuum tube which are designed such that they produce a pressure gradient in the fiber material supply tubes of the spinning rotors. The pressure gradient is oriented in the direction of the fiber supply and effects the fiber supply to the spinning rotors.

In this context it is noted again that the invention does not concern the concept and construction of combined or integrated spinning and twisting devices, but is concerned exclusively with the correlated concept of fiber material supply into the space which is surrounded by the outer housing 2 of the two-for-one twisting spindle A.

This concept resides substantially in that a fiber material disentangling apparatus B is to be correlated to the individual two-for-one twisting spindle A within a tight space such that, on the one hand, a reliable fiber material supply into the spinning rotors within the two-for-one twisting spindle and, on the other hand, a simple access of the two-for-one twisting spindle are ensured. However, it is also desirable to provide the fiber material disentangling apparatus with only a minimal number of drive elements.

The optimal access to the two-for-one twisting spindle is realized in that the central axis of the individual two-for-one twisting spindle A is slanted relative to a vertical line at a certain angle so that after removal of the housing cover 2.1 a substantially direct access to the interior of the two-for-one twisting spindle is possible. Because of the slanted arrangement of the two-for-one twisting spindle, there is space underneath it for mounting the fiber material disentangling apparatus B whose two disentangling units 3 are connected by fiber supply tubes 8 to diametrically opposed locations at the outer housing 2 of the two-for-one twisting spindle A. For this purpose, the two fiber supply tubes 8 have a curved section with a directional change angle $\alpha$ in the magnitude of 95 to 105° and a radius of curvature r drawn through the central line of the tube having a magnitude of 30 to 40 mm. In order to provide an optimal alignment of the fibers flowing through the fiber supply tube 8, the fiber supply tube in the area of the circular arc is designed such that the inner tube diameter at the beginning of the curvature is preferably 8 mm and at the end of the curvature is preferably 6 mm. The diameter reduction is linear or continuous.

For such dimensions of the fiber supply tube 8, especially in the area of the circular arc, the turbulence and secondary flows occurring within curved portions especially in the area of the inner curvature during fiber material transport substantially lose their negative effects.

The specification incorporates by reference the disclosure of European priority document 99 102 330.0 of Feb. 6, 1999 and German priority document 199 05 184.4 of Feb. 9, 1999.

The present invention is, of course, in no way restricted to the specific disclosure of the specification and drawings, but also encompasses any modifications within the scope of the appended claims.

What is claimed is:

1. A device for producing a twisted yarn in an integrated or combined spinning and twisting process, comprising:

a two-for-one twisting spindle having at least two spinning rotors that are disposed within a yarn balloon produced by the twisting process and that are provided for producing individual yarns that are to be twisted; and a fiber material disentangling apparatus disposed at least partially below said two-for-one twisting spindle and comprised of two fiber material disentangling units, wherein said fiber material disentangling apparatus includes common drive elements for both of said disentangling units, and wherein disentangled fiber material is supplied from said fiber material disentangling apparatus to said spinning rotors of said two-for-one twisting spindle via respectively associated fiber material supply tubes that communicate with said disentangling units and that are interrupted only within a region of said yarn balloon or a yarn guide wherein said two-for-one twisting spindle is disposed centrally above said fiber material disentangling and supply apparatus, and wherein a central axis of said twisting spindle is positioned at a slant relative to a vertical line.

2. A device according to claim 1, wherein said central axis of said two-for-one twisting spindle is positioned at a slant angle of 68 to 76° relative to a vertical line.

3. A device according to claim 1, wherein said two-for-one twisting spindle is provided with an outer housing having a housing cover that is provided with a central centering opening and supports on its outer side a yarn deflecting roller.

4. A device according to claim 1, wherein each of said fiber supply tubes, is curved over a portion of its length with a circular arc, wherein an angle as of directional change of said curved portion is within a range of 95 to 105° and has a ratio of $\alpha/r$=2.5 to 3.5 relative to a radius of curvature (r) of a center line of said supply tube.

5. A device according to claim 4, wherein said angle of directional change $\alpha$ is 98.8°.

6. A device according to claim 4, wherein relative to said center line of said supply tube, said radius of curvature (r) has a magnitude of 30 to 40 mm, preferably 35 mm.

7. A device according to claim 6, wherein said curved portion of said supply tube has an inner diameter that decreases continuously from 8 mm to 6 mm.

8. A device according to claim 1, wherein two of said spinning rotors are positioned axis-symmetrically to a center axis of said two-for-one twisting spindle, and wherein said supply tubes are connected at diametrically opposed locations to an outer housing of said two-for-one twisting spindle.

9. A fiber supply tube for disentangled fiber material that is to be transported by compressed air flow or suction through said tube, wherein said tube has a circular arc over a portion of its length, and wherein an angle $\alpha$ of curvature or directional change of said circular arc is in the range of 95 to 105° and has a ratio relative to a radius of curvature (r) of a center line of said tube of $\alpha/r$=2.5 to 3.5 wherein said radius of curvature (r) has a magnitude of 30 to 40 mm, and wherein said circular arc has an inner diameter that decreases continuously from 8 mm to 6 mm.

10. A fiber supply tube according to claim 9, wherein said radius of curvature (r) has a magnitude of 30 to 40 mm.

11. A fiber supply tube according to claim 9, wherein said radius of curvature (r) has a magnitude of 35 mm.

12. A fiber supply tube according to claim 9, wherein said angle $\alpha$ of curvature or directional change is of 98.8°.

13. A fiber supply tube according to claim 9, wherein said circular arc has an inner diameter that decreases continuously from 8 mm to 6 mm.

14. A device according to claim 2, wherein said central axis of said two-four-one twisting spindle is positioned at a slant angle of 72° .

* * * * *

UNITED STATES PATENT AND TRADEMARK OFFICE

CERTIFICATE OF CORRECTION

PATENT NO. : 6,311,468 B1
DATED : November 6, 2001
INVENTOR(S) : Beckmann et al.

It is certified that error appears in the above-identified patent and that said Letters Patent is hereby corrected as shown below:

Title page,
The following item should read as follows:

Item [57] ABSTRACT,
The ABSTRACT [57] should read as follows:

-- A device for producing a twisted yarn by an integrated or combined spinning and twisting process is provided and comprises a two-for-one twisting spindle with at least two spinning rotors, positioned within the yarn balloon produced by the twisting process, for producing the individual yarns to be twisted, into which spinning rotors the disentangled fiber material is supplied respectively by the fiber supply tubes, which are connected to the fiber material disentangling units. The fiber material disentangling units are combined to a single fiber material disentangling apparatus with common drive elements for the two disentangling units. The fiber material disentangling apparatus is arranged at least partially below the two-for-one twisting spindle so that the individual spindles can be arranged relatively closely adjacent to one another, wherein each fiber supply tube follows over a portion of its length a circular arc wherein the angle $\alpha$ of directional change to the radius of curvature (r) of the central line of the tube has a ratio of $\alpha/r=2.5$ to 3.5. --

Signed and Sealed this

Twenty-eighth Day of May, 2002

*Attest:*

*Attesting Officer*

JAMES E. ROGAN
*Director of the United States Patent and Trademark Office*